US007920712B2

(12) United States Patent
Butler

(10) Patent No.: US 7,920,712 B2
(45) Date of Patent: Apr. 5, 2011

(54) COAXIAL MID-FREQUENCY AND HIGH-FREQUENCY LOUDSPEAKER

(75) Inventor: Nathan David Butler, Leominster, MA (US)

(73) Assignee: Loud Technologies Inc., Woodinville, WA (US)

( * ) Notice: Subject to any disclaimer, the term of this patent is extended or adjusted under 35 U.S.C. 154(b) by 1254 days.

(21) Appl. No.: 11/450,900

(22) Filed: Jun. 8, 2006

(65) Prior Publication Data

US 2006/0285712 A1 Dec. 21, 2006

Related U.S. Application Data

(60) Provisional application No. 60/689,472, filed on Jun. 10, 2005.

(51) Int. Cl.
*H04R 25/00* (2006.01)

(52) U.S. Cl. ..... 381/342; 381/182; 381/337; 381/340; 381/343; 381/345

(58) Field of Classification Search ..... 381/182, 381/337–343
See application file for complete search history.

(56) References Cited

U.S. PATENT DOCUMENTS

| | | | | |
|---|---|---|---|---|
| 4,706,295 | A * | 11/1987 | Putnam et al. | 381/342 |
| 5,109,423 | A * | 4/1992 | Jacobson et al. | 381/336 |
| 5,526,456 | A | 6/1996 | Heinz | |
| 6,094,495 | A | 7/2000 | Rocha | |
| 6,628,796 | B2 * | 9/2003 | Adamson | 381/342 |
| 7,236,606 | B2 * | 6/2007 | Werner | 381/342 |
| 2005/0265570 | A1 * | 12/2005 | Isotalo | 381/337 |

* cited by examiner

*Primary Examiner* — Curtis Kuntz
*Assistant Examiner* — Jasmine Pritchard
(74) *Attorney, Agent, or Firm* — Christensen O'Connor Johnson Kindness PLLC

(57) ABSTRACT

A loudspeaker is provided for receiving an electrical signal and transmitting an acoustic signal through a transmission medium. The system includes generally two elements: a coaxial transducer and an acoustic transformer. The coaxial transducer includes a high-frequency driver and a mid-frequency driver that are coaxially arranged. The acoustic transformer is acoustically coupled to the coaxial transducer and includes an initial horn section that expands from a first end to a second end in a direction away from the coaxial transducer. The initial horn section defines a plurality of openings therethrough, such that the initial horn section is acoustically opaque to high-frequency acoustic signals to thereby function as a waveguide for the high-frequency acoustic signals, while it is acoustically transparent to mid-frequency acoustic signals.

22 Claims, 13 Drawing Sheets

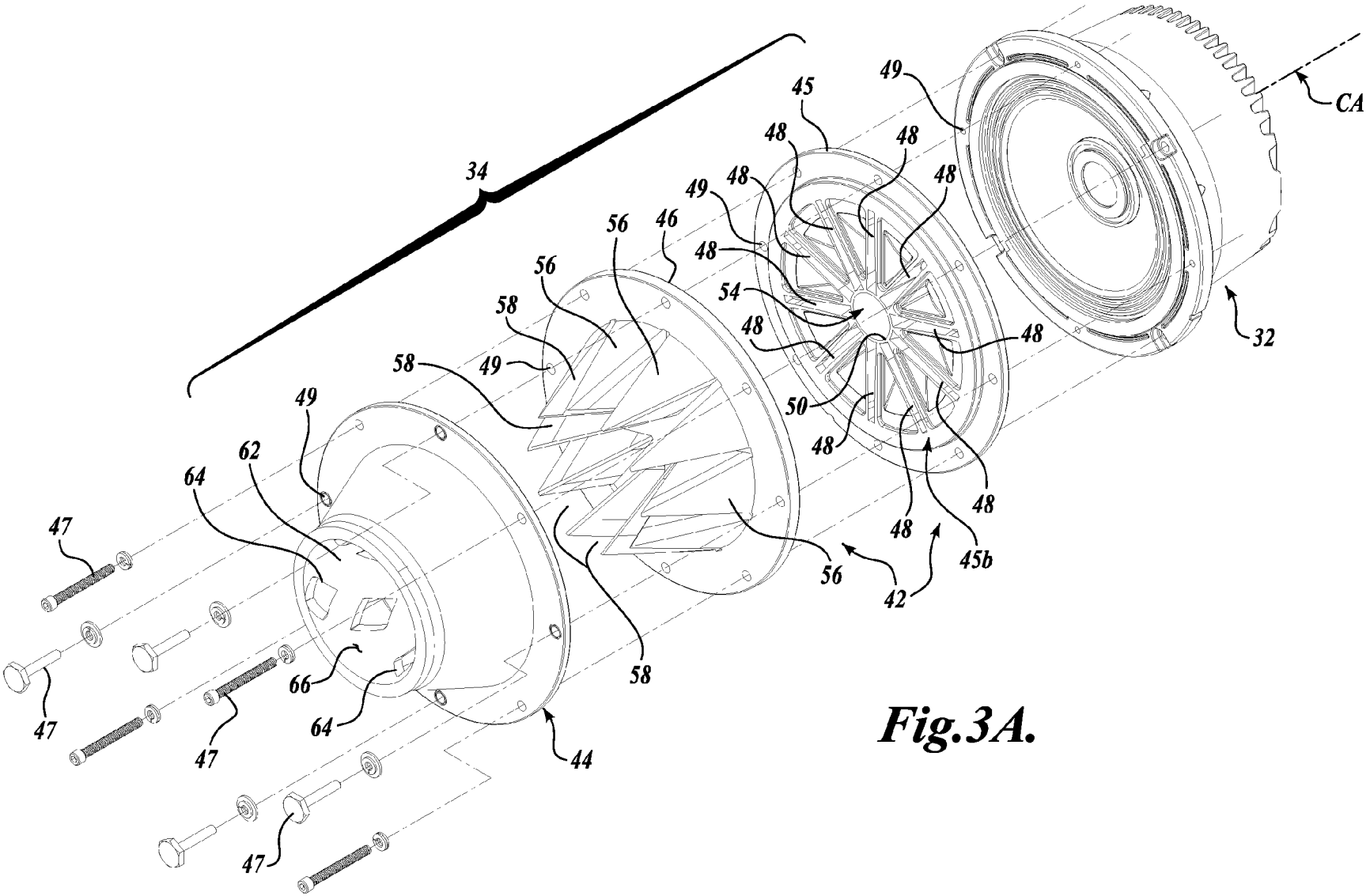
CA
32
49
48
45
48
48
48

COAXIAL MID-FREQUENCY AND HIGH-FREQUENCY LOUDSPEAKER

CROSS-REFERENCE TO RELATED APPLICATION

The present application claims the benefit of U.S. Provisional Application No. 60/689,472, filed Jun. 10, 2005.

FIELD OF THE INVENTION

The present invention relates generally to loudspeakers and, more particularly, to loudspeakers that efficiently and accurately couple acoustic energy from both a mid-frequency electrical-acoustic transducer and a high-frequency electrical-acoustic transducer to the open air.

BACKGROUND OF THE INVENTION

A loudspeaker is a device which converts an electrical signal into an acoustic signal (i.e., sound) and directs the acoustic signal to one or more listeners. In general, a loudspeaker includes an electromagnetic transducer (also referred to as a "driver") that receives and transforms the electrical signal into a mechanical vibration. The mechanical vibrations produce localized variations in pressure about the ambient atmospheric pressure, and the pressure variations propagate within the atmospheric medium to form the acoustic signal.

A loudspeaker including multiple transducers (or drivers) and a single horn is known. For example, U.S. Pat. No. 5,526,456, which is incorporated by reference herein, describes a loudspeaker including one or more low frequency drivers and one or more high frequency drivers that are coaxially arranged with respect to the centerline of the loudspeaker. The loudspeaker further includes a single horn, which acts as a waveguide for the sound produced by both the low and high frequency drivers. The present description uses the term "coaxial transducer" to refer to a set of two or more drivers (transducers) that are coaxially arranged, i.e., with one driver in front of, or on the same axis of, another driver.

The successful implementation of such coaxial transducers in loudspeakers, however, poses certain engineering challenges. Coaxial transducers have generally been designed for use in two-way, full-range, low Q systems. (Q, or the directivity factor, is the ratio of the intensity of a source at a given location, to the intensity produced at the same location by a point source (omnidirectional source) radiating the same acoustic power.) Referring to FIG. 1, a coaxial transducer 10 typically includes a cone-type mid-frequency (MF) driver 14 having a cone-shaped diaphragm 11 (for example, with the diameter of 8", 10", 12", or 15") and a high-frequency (HF) compression driver 16. As used herein, MF refers to a frequency range of about 200 Hz to 2 kHz, and HF refers to a frequency range over about 2 kHz. The HF compression driver 16 is mounted on the back of the MF driver's motor structure so that the HF driver 16 produces (or fires) HF acoustic signals through the center of the MF driver 14. To this end, the MF driver's pole piece is hollowed out and shaped to provide an initial horn 18 for the HF driver 16. The initial horn 18 (acting as a waveguide for the HF acoustic signals) terminates at the rear end 11*a* of the cone-shaped diaphragm 11, from which the cone-shaped diaphragm itself becomes a continuation of the HF waveguide, leading to a horn 20. Thus, essentially, the MF cone-shaped diaphragm 11 acts as a low Q conical waveguide for the HF acoustic signals. The conventional coaxial transducer 10 constructed in this manner, however, suffers from inherently low Q because it cannot be successfully loaded to a horn 20 for the following reason.

A classic horn design rule, well known in the art, requires that the horn curvature angle should always increase along the path of the horn. As shown in FIG. 1, simply loading the coaxial transducer 10 to the horn 20 would break this rule. Specifically, although the initial horn 18 and the cone-shaped diaphragm 11 expand at an increasing rate (e.g., from A=9°, B=23°, and to C=58° in the illustration), the rate of expansion decreases at the throat (or the rear end) 20*a* of the horn 20 (from C=58° to D=27° in the illustration). It would be intuitively obvious to one skilled in the art that this design would cause significant reflections off the walls of the horn 20, causing the acoustic signals to arrive at an observer (listener) at multiple times, thereby destroying the temporal coherence of the original signals and further creating various attendant problems (e.g., side lobes and transient smearing).

The present invention is directed to loading a coaxial transducer to a common horn, without disturbing the temporal coherence of the original signals, thus preventing multiple arrival times of signals and any other interference issues. In view of the challenge discussed above, a need exists for a way to load a coaxial transducer to a common horn which provides for (1) constant expansion of a waveguide for acoustic signals, and hence (2) temporal coherence of acoustic signals.

SUMMARY OF THE INVENTION

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present invention, a loudspeaker is provided for receiving an electrical signal and transmitting an acoustic signal through a transmission medium. The loudspeaker includes generally two components: a coaxial transducer and an acoustic transformer. The coaxial transducer further includes (i) a high-frequency (HF) driver arranged to transmit high-frequency acoustic signals generally along a central axis of the coaxial transducer, and (ii) a mid-frequency (MF) driver that is coaxially arranged relative to the high-frequency driver and that includes a diaphragm about the central axis of the coaxial transducer. Mid-frequency acoustic signals are transmitted through the diaphragm. The acoustic transformer, also known as a phase plug, is arranged adjacent to the coaxial transducer. The acoustic transformer includes a first end positioned adjacent to the coaxial transducer and a second end opposite therefrom. The acoustic transformer includes generally two functional components (i) a plurality of waveguides that transmit the mid-frequency acoustic signals from the diaphragm to the second end of the acoustic transformer, and (ii) an initial horn section that expands in a direction from the first end to the second end of the acoustic transformer. The initial horn section is configured such that it is acoustically substantially opaque to the high-frequency acoustic signals to thereby function as an expanding waveguide for the high-frequency acoustic signals, while it is acoustically substantially transparent to the mid-frequency acoustic signals to thereby transmit the mid-frequency acoustic signals exiting from the plurality of waveguides, via the initial horn section, to the second end of the acoustic transformer.

Accordingly, the present invention provides a coaxial mid-frequency and high-frequency loudspeaker that achieves and realizes (1) constant expansion of a waveguide for acoustic signals, in particular HF signals, and hence (2) temporal coherence of acoustic signals. Specifically, the initial horn section provided in the acoustic transformer functions as an expanding waveguide for HF signals, which can then be coupled to an increasingly expanding loudspeaker horn. Further, the acoustic transformer is configured to deliver temporally coherent MF/HF signals to the loudspeaker horn.

In accordance with one aspect of the present invention, the initial horn section is formed generally in the shape of a truncated cone, while in other aspects the initial horn section may take various other forms. In accordance with another aspect of the present invention, the initial horn section includes a plurality of openings so as to be acoustically transparent to MF signals while at the same time being acoustically opaque to HF signals. In accordance with a still further aspect of the present invention, a ratio of the openings to the total area of the initial horn section (i.e., the ratio between a total area of the openings through the initial horn section and a total area of the initial horn section) ranges from about 15% to 30% and, more specifically, the ratio may be about 20%.

In accordance with yet another aspect of the present invention, the acoustic transformer consists of two elements: (a) a phase plug core; and (b) a phase plug body that generally encloses the phase plug core, to together define the plurality of waveguides for transmitting the MF acoustic signals. In one aspect of the present invention, the initial horn section is part of the phase plug body. In another aspect of the present invention, the phase plug core further includes two components: (i) a radially slotted disk defining a plurality of radially extending slots; and (ii) a radial peak/valley member defining a plurality of valleys between a plurality of peaks. The plurality of radially extending slots and the plurality of valleys are aligned so as to together form the plurality of (radial) waveguides extending through the acoustic transformer substantially in parallel to the central axis of the coaxial transducer. In a different aspect of the present invention, the plurality of waveguides are not radially arranged and arranged instead, for example, linearly.

In accordance with a different aspect of the present invention, the high-frequency driver and the mid-frequency driver in the coaxial transducer share a single magnet.

In accordance with still another aspect of the present invention, the loudspeaker may further include one or more low-frequency drivers that are arranged about the coaxial transducer. For example, two low-frequency drivers may be provided on both sides of the coaxial transducer about the central axis of the coaxial transducer.

In accordance with another embodiment of the present invention, a loudspeaker is provided for receiving an electrical signal and transmitting an acoustic signal through a transmission medium. The system includes generally two elements: a coaxial transducer and an acoustic transformer. The coaxial transducer includes a high-frequency driver and a mid-frequency driver that are coaxially arranged. The acoustic transformer is acoustically coupled to the coaxial transducer and includes an initial horn section that expands from a first end to a second end in a direction away from the coaxial transducer. The initial horn section defines a plurality of openings therethrough, such that the initial horn section is acoustically opaque to high-frequency acoustic signals to thereby function as a waveguide for the high-frequency acoustic signals, while at the same time it is acoustically transparent to mid-frequency acoustic signals.

In accordance with yet another embodiment of the present invention, a method is provided for delivering both high-frequency and mid-frequency acoustic energy through a loudspeaker including a horn. The method includes generally three steps. First, a high-frequency driver is provided to produce high-frequency acoustic energy. Second, a mid-frequency driver configured to produce mid-frequency acoustic energy is arranged in a manner coaxial to the high-frequency driver. Third, an acoustic transformer including an initial horn section is arranged. The initial horn section is acoustically substantially opaque to the high-frequency acoustic energy, while it is acoustically substantially transparent to the mid-frequency acoustic energy. Also, the initial horn section expands from a first end to a second end in a direction away from the high-frequency driver to thereby function as a waveguide for the high-frequency acoustic energy leading to the horn of the loudspeaker. At the same time, the acoustic transformer is configured to deliver the mid-frequency acoustic energy in a temporally coherent manner from the mid-frequency driver via the initial horn section to the horn of the loudspeaker.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 3A is an exploded view of a coaxial transducer and an acoustic transformer included in the loudspeaker of FIG. 2A;

DETAILED DESCRIPTION OF THE PREFERRED EMBODIMENT

Figure 1:
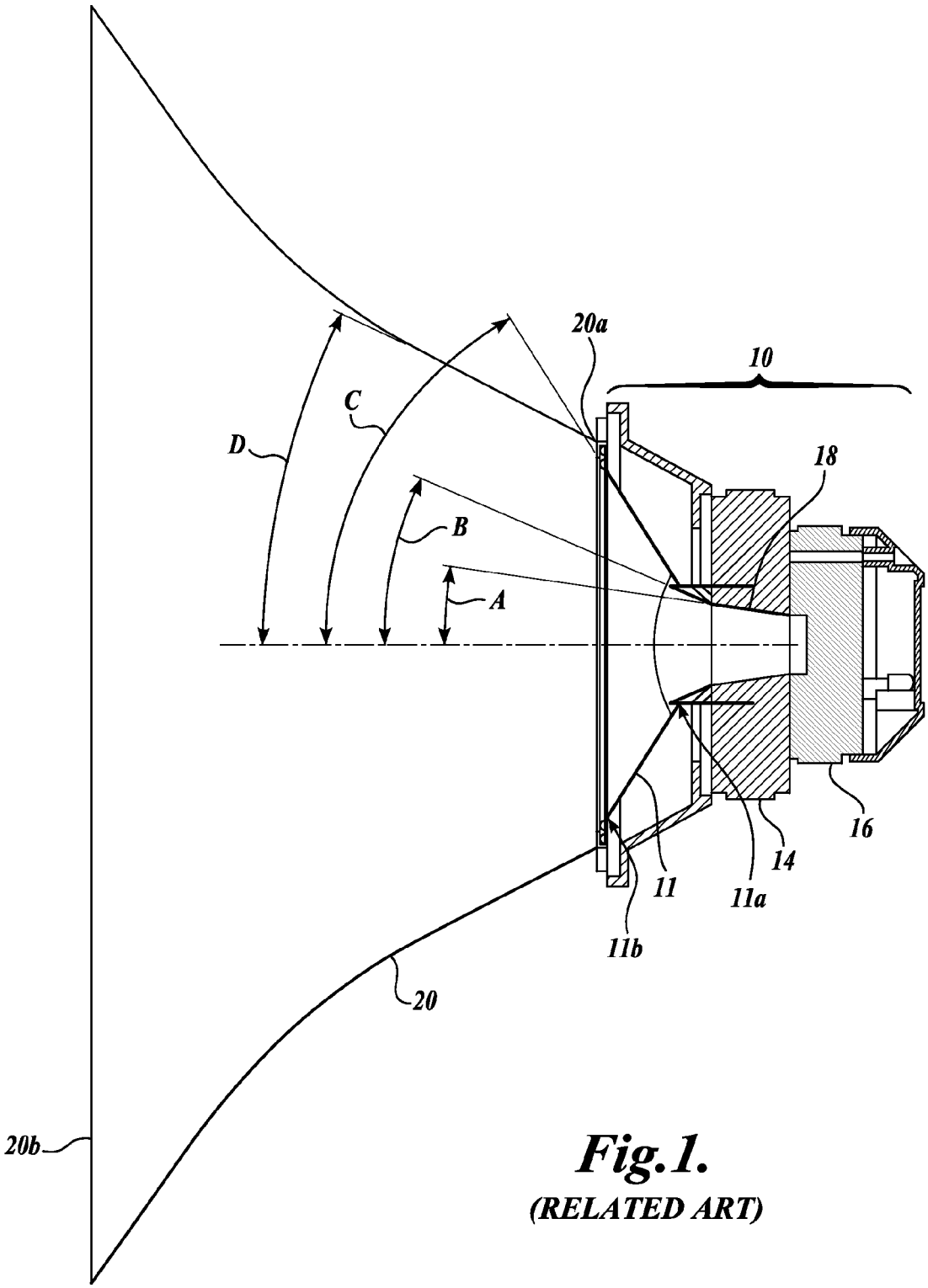
Fig.1. (RELATED ART)
FIG. 1 illustrates the challenge associated with loading a conventional coaxial MF/HF transducer to a common horn.
Figure 2A:
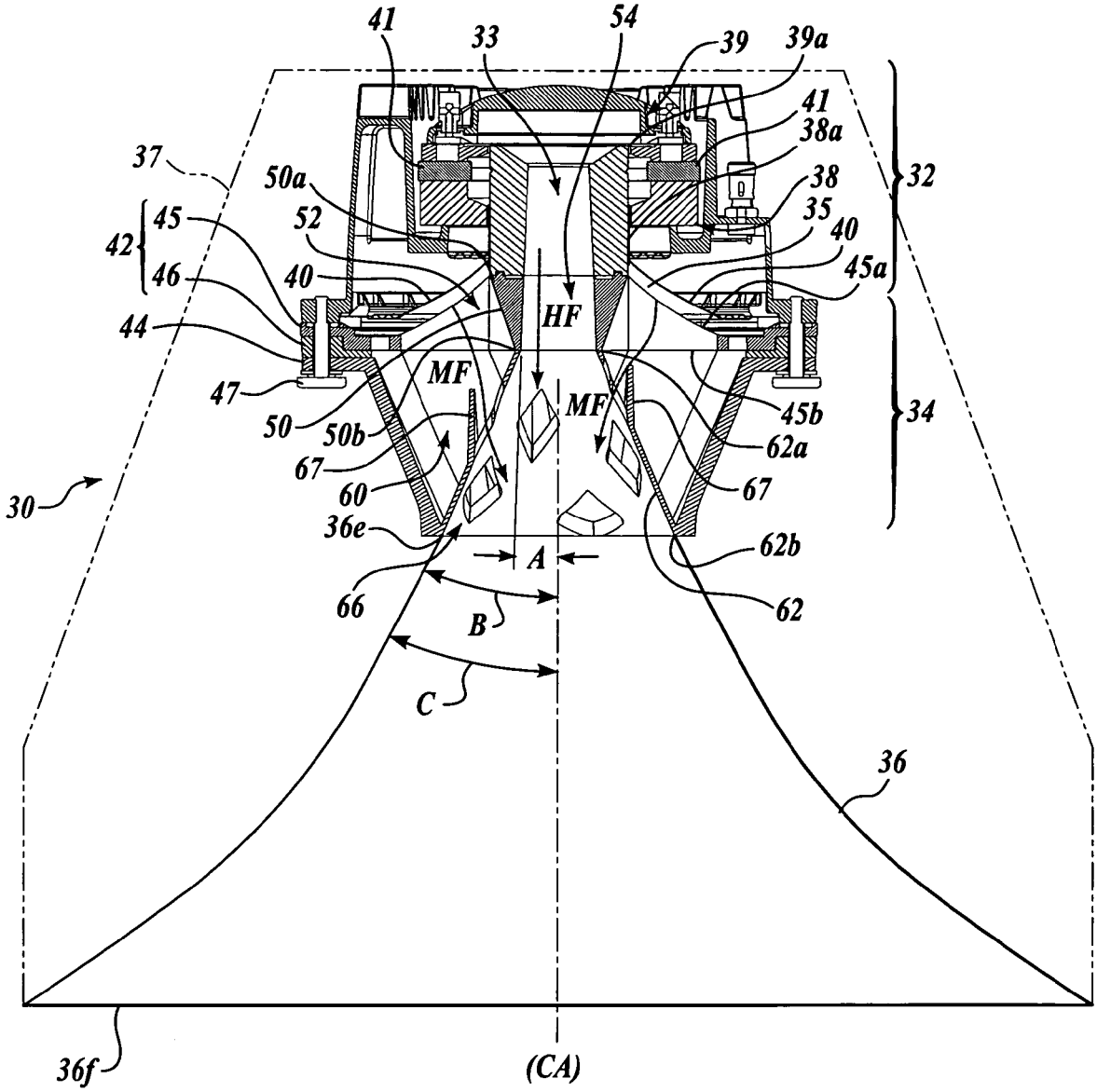
FIG. 2A is a cut-away top view of a coaxial mid-frequency and high-frequency loudspeaker formed in accordance with one embodiment of the present invention.
Figure 2B:
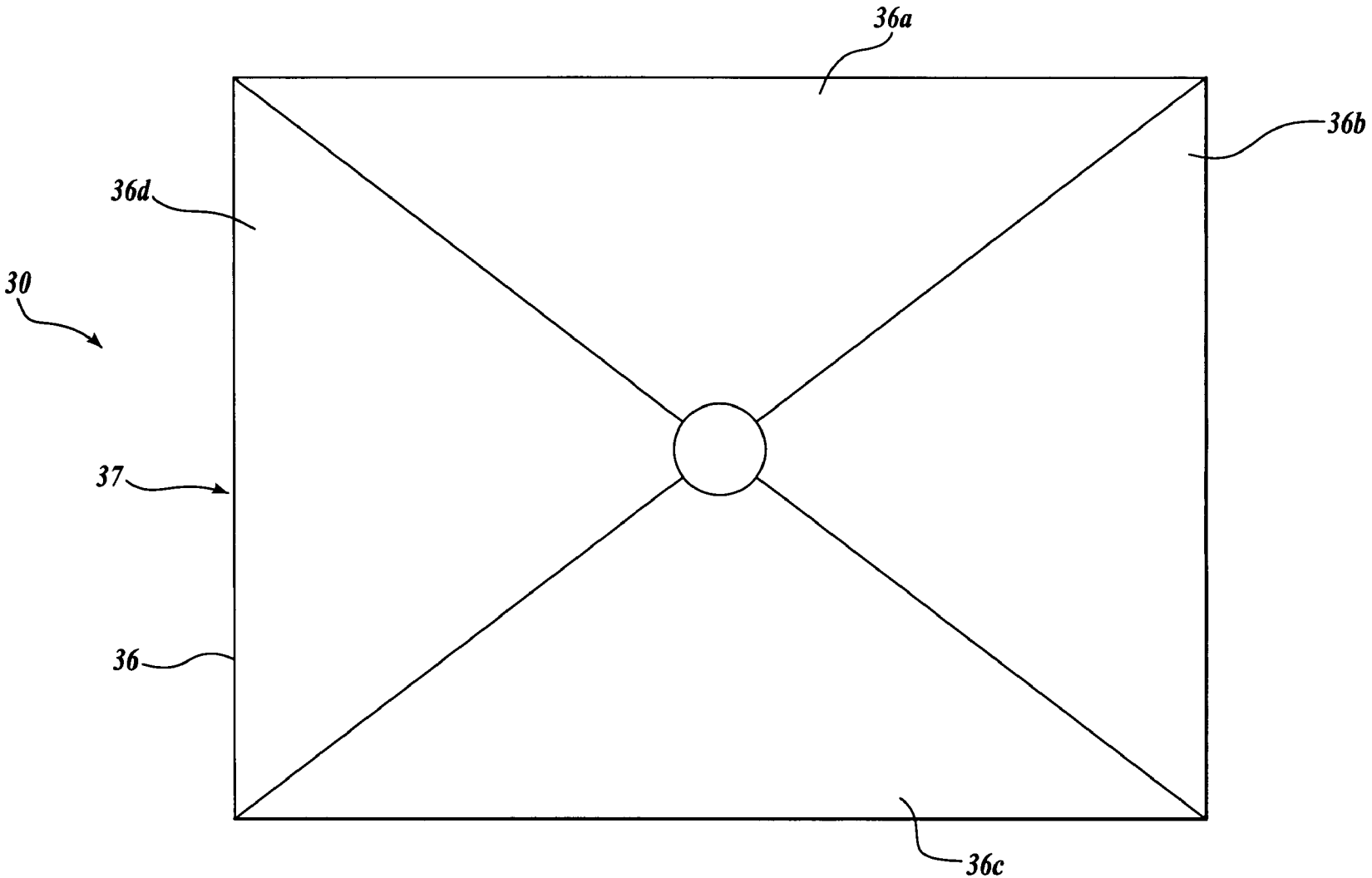
FIG. 2B is a front view of the loudspeaker of FIG. 2A.

FIGS. 2A and 2B illustrate a coaxial mid-frequency (MF) and high-frequency (HF) loudspeaker 30 formed in accordance with one embodiment of the present invention. The loudspeaker 30 is configured to receive an electrical signal and transmit an acoustic signal through a transmission medium (e.g., through the air), and includes a coaxial transducer 32 and an acoustic transformer 34. The coaxial transducer 32 is a combination of two or more coaxially arranged drivers that each receives an electrical signal and produces an acoustic signal representative of the electrical signal, while the acoustic transformer 34 serves to match the coaxial transducer 32 to the transmission medium. As shown, the loudspeaker 30 may also include a horn 36 arranged adjacent to the acoustic transformer 34. As best shown in FIG. 2B, which is a front view of the loudspeaker 30, the horn 36 may have a rectangular mouth defined by four sidewalls 36*a*-36*d*. As will be apparent to one skilled in the art, the horn 36 may take various forms that are configured to efficiently transmit and project acoustic energy depending on each application, and as such is not limited to the particular configuration as illustrated. The loudspeaker 30 may further be contained in an enclosure 37.

The coaxial transducer 32 includes two or more coaxially arranged drivers (transducers), for example, an MF driver 38 with an MF voice coil 38*a* and an HF driver 39 with an HF voice coil 39*a*. The MF driver 38 also includes a diaphragm 40, such as a cone-shaped diaphragm in the illustrated embodiment, from which mid-frequency acoustic signals are transmitted. As used herein, the term "diaphragm" means any surface that vibrates to emit or radiate acoustic energy. As will be apparent to one skilled in the art, a diaphragm may take various configurations depending on each application. Also as used herein, the term "driver" means a combination of a diaphragm (which vibrates to move the air) and a voice coil, magnet, etc. (which cause the diaphragm to vibrate) to output an acoustic signal based on an electrical signal input. In the illustrated embodiment, the high-frequency acoustic signals from the HF compression driver 39 are transmitted through a central cylindrical portion 33 hollowed out through the pole piece of the MF driver 38 along the central axis (CA) of the coaxial transducer 32. In the illustrated embodiment, the central axis of the coaxial transducer 32 is generally aligned with the central axis of the loudspeaker 30, though in other embodiments these axes need not coincide with each other. In one embodiment, the MF driver 38 consists of a 2.5-inch voice coil and an 8-inch cone-shaped diaphragm, while the HF driver 39 consists of a 1.4-inch exit compression driver with a 2.5 inch voice coil.

In accordance with various exemplary embodiments of the present invention, the MF and HF drivers 38 and 39 may share a common neodymium magnet 41, to thereby reduce the weight of the coaxial transducer 32. The common magnet allows for minimizing the distance between the voice coils 38*a* and 39*a* of the MF and HF drivers 38 and 39 and hence their acoustic origins.

Though not illustrated, the loudspeaker 30 is first connected to an amplifier or other system well known in the art for providing the electrical signals that are necessary to power the MF and HF drivers 38 and 39. It should also be apparent to one skilled in the art that the construction of a coaxial transducer 32 is not limited to that which is shown in FIG. 2A and various other arrangements are possible. Further, not all parts and details are shown in FIG. 2A for the purpose of clarity only.

Figure 3B:
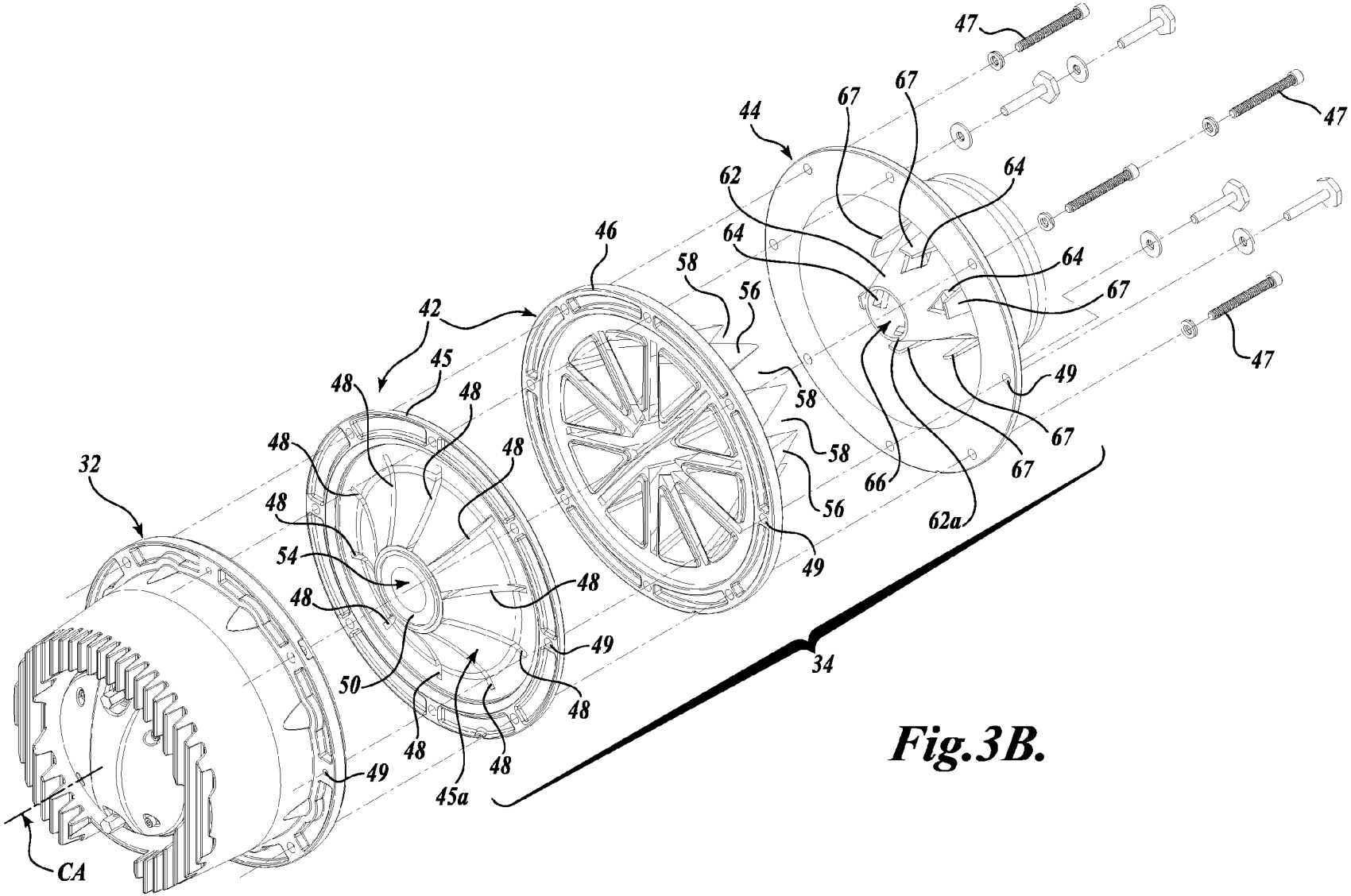
FIG. 3B is another exploded view of the coaxial transducer and the acoustic transformer of FIG. 3A, viewed from a different angle.

Referring additionally to FIGS. 3A and 3B, the construction and operation of the acoustic transformer (also referred to as a "phase plug") 34 are described. Essentially, the acoustic transformer 34 serves to couple the acoustic energy from the transducer 32 to the loudspeaker horn 36 in a temporally coherent manner. In one embodiment as illustrated, the acoustic transformer 34 includes a phase plug core 42 and a phase plug body 44. The phase plug core 42 may further consist of a radially slotted disk 45 and a radial peak/valley member 46. The phase plug body 44 and the phase plug core 42 (including the radially slotted disk 45 and the radial peak/valley member 46) are secured to the coaxial transducer 32 using a suitable number of bolts 47 (with washers) extending through holes 49 defined through the various components. The acoustic transformer 34, in particular its phase plug core 42, is a modification or extension of an acoustic transformer disclosed in U.S. Pat. No. 6,094,495 ("the '495 patent"), which is explicitly incorporated by reference herein. As described in the '495 patent, the acoustic transformer defines a plurality of waveguides that all extend generally along (or substantially in parallel to) the central axis of a loudspeaker to transmit acoustic signals therealong while maintaining their temporal coherence. In other words, the acoustic transformer delivers temporally coherent acoustic energy from the coaxial transducer to the horn of the loudspeaker. In various exemplary embodiments, the acoustic transformer 34 (and the coaxial transducer 32) may be particularly configured to equalize acoustic path lengths of the acoustic signals traveling from the coaxial transducer through the acoustic transformer, in accordance with the disclosure of the '495 patent. In the acoustic transformer, the plurality of waveguides may be arranged in various configurations, such as in a radial configuration as will be described below, or in a linear configuration, as long as they serve to deliver temporally coherent acoustic energy therethrough.

In the illustrated embodiment, the radially slotted disk 45 defines a plurality of radial slots 48 that extend radially and are arranged equiangularly (at equal angle intervals) about the central axis (CA) of the coaxial transducer 32. The slotted disk 45 of FIGS. 3A and 3B includes ten (10) radial slots 48, though the number of slots may vary depending on each application, as will be apparent to one skilled in the art. As best shown in FIGS. 2A and 3B, the rear face 45*a* of the radially slotted disk 45 is shaped to generally coincide with the shape of the diaphragm 40 so as to form a reduced volume air chamber 35 between the surface of the diaphragm 40 and the rear face 45*a* of the radially slotted disk 45. The reduced volume air chamber 35 is substantially uniform, i.e., the spacing between the diaphragm 40 and the rear face 45*a* of the radially slotted disk 45 is substantially constant. On the other hand, the front face 45*b* (see FIG. 3A) of the radially slotted disk 45 is substantially flat. The radially slotted disk 45 further includes a central core 50 (see FIG. 2A), which is generally in a truncated conical shape. In the illustrated embodiment of FIG. 2A, the outer diameter of the central core 50 gradually decreases from its rear end 50*a* toward its front end 50*b*. Since the radially outer surface of the central core 50 defines the radially inner ends of the plurality of radial slots 48, the distance from the radially inner end of each slot 48 to the central axis (CA) of the coaxial transducer also gradually decreases from the rear end 50*a* toward the front end 50*b* of the central core 50. As a result, a cross-sectional shape of the radial slot 48, cut along the central axis (CA) of the coaxial transducer 32, is generally a triangle shape, as indicated by reference number 52. The central core 50 defines a generally cylindrical bore 54 therethrough, which is coupled to the cylindrical portion 33 hollowed out through the pole piece of the MF driver 38.

The radial peak/valley member 46, in the embodiment shown in FIGS. 3A and 3B, includes a plurality of peaks 56, each being in the form of a triangle-base pyramid. For example, ten such peaks 56 may be formed so as to form ten valleys 58, each between two adjacent peaks 56. As each valley 58 is defined between two adjacent pyramid peaks 56, the cross section of each valley 58 cut along the central axis (CA) of the coaxial transducer is generally a triangle shape, as indicated by reference number 60. When the radially slotted disk 45 and the radial peak/valley member 46 are assembled, the radial slots 48 of the disk 45 and the valleys 58 of the peak/valley member 46 are aligned such that they together form a plurality of waveguides (ten in the illustrated embodiment, each generally shown as a combination of the triangle shapes 52 and 60) that extend generally along the central axis (CA) of the coaxial transducer to transmit MF signals from the diaphragm 40 therethrough.

The radial slotted disk 45 and the radial peak/valley member 46 may be made of any suitable material, such as aluminum, plastic, etc. Also, while they are described as two separate components combined together in the above embodiment, they may be integrally formed as one unit in other embodiments.

The phase plug body 44 is configured to generally enclose the phase plug core 42. Thus, in the illustrated embodiment, the phase plug body 44 takes the form of a truncated cone shape. The phase plug body 44 also includes an internal initial horn section 62, which in the illustrated embodiment takes the form of a truncated cone. The initial horn section 62 generally extends and expands from its rear end 62*a* (placed adjacent to the radial slotted disk 45) to its front end 62*b* (placed adjacent to the throat 36*e* of the horn 36), to essentially function as the initial (throat) section of the horn 36. Thus, depending on the type of horn used in each application, the initial horn section 62 may take a varying configuration to match the particular horn type. For example, though the sidewalls of the initial horn section 62 are illustrated to form a true conical section, they may include some curvature in other embodiments of the present invention.

As shown in FIGS. 3A and 3B, in various exemplary embodiments of the present invention, the initial horn section 62 defines a plurality of openings 64 therethrough. The openings 64 are particularly configured and arranged so as to render the initial horn section 62 acoustically opaque to HF acoustic signals while being acoustically transparent to MF acoustic signals. As used herein, an element is acoustically opaque to acoustic energy when the element substantially blocks the acoustic energy (e.g., any element that can be used to form a waveguide for the acoustic energy) while an element is acoustically transparent to acoustic energy when the acoustic energy can transmit through the element without appreciable interference.

Therefore, as best shown in FIG. 2A, the initial horn section 62 of the phase plug body 44 essentially functions as a waveguide for the HF acoustic signals fired from the HF driver 39 and transmitted through the cylindrical portion 33 and the cylindrical bore 54. Also as illustrated, the front end 62*b* of the initial horn section 62 may connect to the rear end (or throat) 36*e* of the horn 36. Accordingly, the combination of the cylindrical portion 33, the cylindrical bore 54, the initial horn section 62, and the horn 36 jointly forms a waveguide that expands at an increasing rate toward the front end (or mouth) 36*f* of the horn 36. Specifically, the angle of a waveguide sidewall relative to the central axis (CA) of the coaxial transducer 32 may expand from angle A (for the cylindrical portion 33 and the cylindrical bore 54), angle B (for the initial horn section 62), to angle C (for the horn 36). In one example, angles A, B, and C may be 2°, 22°, and 27°, respectively, though of course, other increasing angles may also be used depending on each application. It should be appreciated in view of FIG. 2A that for the initial horn section 62 to form part of the waveguide for HF acoustic signals, its sidewall should be acoustically substantially opaque to HF acoustic signals, as will be more fully described below.

The phase plug body 44 generally encloses the phase plug core 42 and provides an exterior boundary for the phase plug core 42 and hence for the plurality of radial waveguides extending therethrough. As described above, the acoustic transformer 34, including the plurality of waveguides therethrough is configured to efficiently transfer the MF acoustic signals from the coaxial transducer 32 (or, more specifically, from the MF diaphragm 40) to the horn 36 while maintaining their temporal coherence. In other words, the acoustic transformer 34 delivers temporally coherent MF signals from the coaxial transducer 32, through its plurality of waveguides, to the throat 36*e* of the horn 36. It should be appreciated in view of FIG. 2A that for MF signals exiting from the plurality of waveguides of the acoustic transformer 34 to reach the throat 36*e* of the horn 36, the sidewall of the initial horn section 62 should be acoustically substantially transparent to MF acoustic signals, as will be more fully described below.

The phase plug body 44 may be made of any suitable material, such as plastic, aluminum, etc. Also, while the phase plug body 44 is described as a separate component from the phase plug core 42 in the above-described embodiments, it may be integrally formed with the phase plug core 42 in other embodiments.

As described above, the openings 64 may be defined through the sidewall of the initial horn section 62 such that the resulting initial horn section 62 becomes acoustically transparent to MF acoustic signals. Thus, the MF acoustic signals, transmitted from the diaphragm 40 of the MF driver 38 and traveling through the plurality of waveguides defined by the phase plug core 42 and the phase plug body 44, may exit from the waveguides and enter the generally conical volume 66 surrounded by the initial horn section 62 through the sidewall surface (or, more specifically, through the openings 64) of the initial horn section 62. In the illustrated embodiment, ten such waveguides are defined (based on ten radial slots 48 and ten corresponding valleys 58) and therefore ten openings 64 are defined in the initial horn section 62 to each provide an exit for the corresponding waveguide into the conical volume 66. The MF acoustic signals then travel through the conical volume 66 and the horn 36 to be transmitted into the air. Note that the acoustic transformer 34 delivers temporally coherent MF signals from the MF driver 38 to the throat 36*e* of the horn 36, and hence the MF signals transmitted from the mouth 36*f* of the horn 36 into the air are also temporally coherent.

In accordance with various exemplary embodiments of the present invention, the openings 64 through the initial horn section 62 are defined based on intersecting arcs or circles. The inventors of the present application have found that, when the openings 64 are defined based on intersecting arcs, they essentially become acoustically opaque to HF acoustic signals while being acoustically transparent to MF acoustic signals.

Figure 4A:
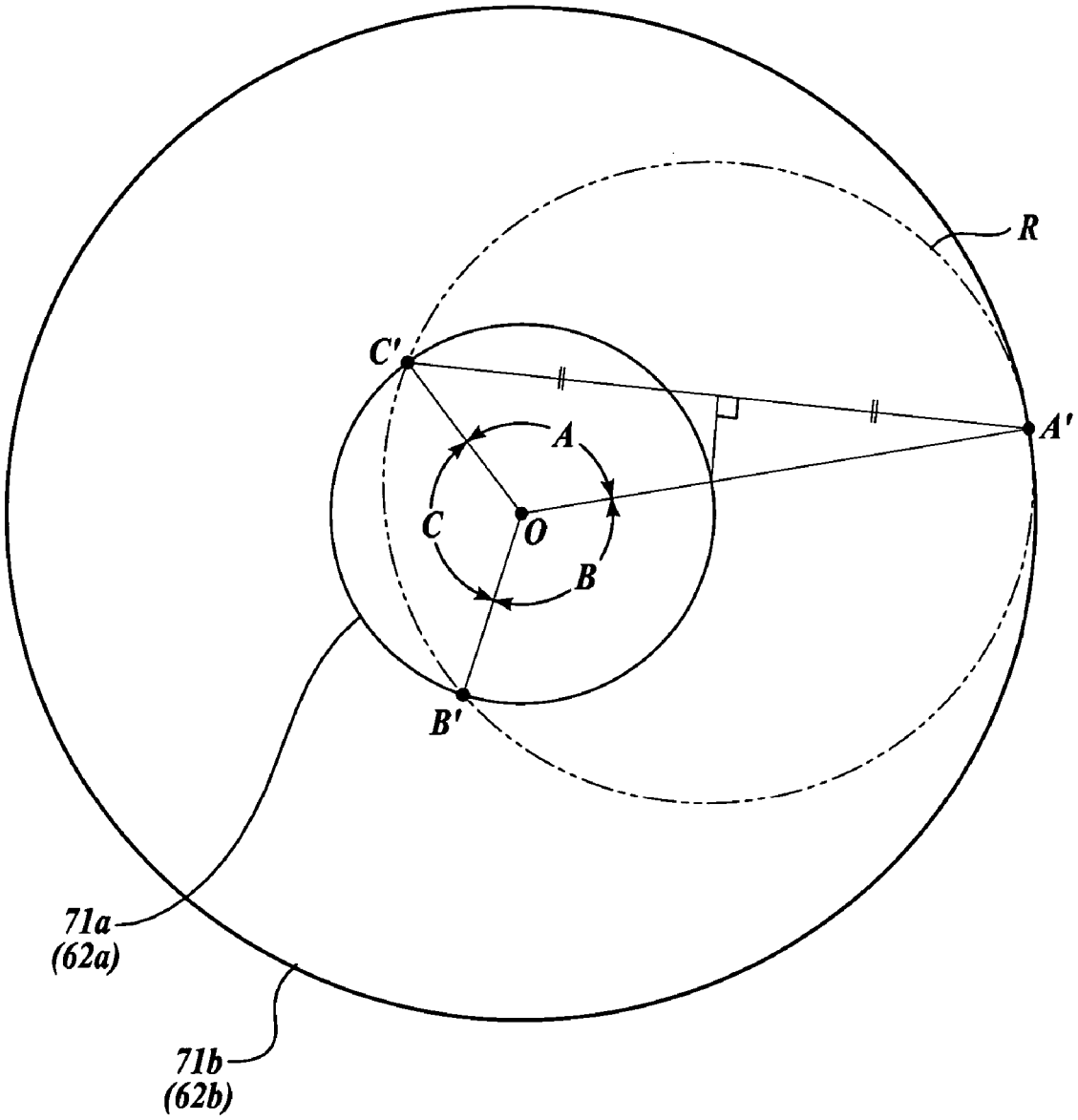
FIGS. 4A-4G illustrate a process of defining openings through an initial horn section of an acoustic transformer based on intersecting arcs, in accordance with one aspect of the present invention.

FIGS. 4A-4F illustrate one method of defining a plurality of openings in the initial horn section 62 based on intersecting arcs. FIG. 4A shows a ring-like surface representing a surface of the initial horn section 62, which is defined by an inner edge 71*a* (corresponding to the rear end 62*a* of the initial horn section 62) and an outer edge 71*b* (corresponding to the front end 62*b* of the initial horn section 62). The circle defined by the inner edge 71*a* is divided into three sectors defined by their respective angles A, B, and C (e.g., A=B=117° and C=126°). The line between the sectors defined by angles A and B is extended to intersect with the outer edge 71*b* at point A', to thereby form line O-A'. The line between the sectors defined by angles B and C is extended to intersect with the inner edge 71*a* at point B', to thereby form line O-B'. Lastly, the line between the sectors defined by angles C and A is extended to intersect with the inner edge 71*a* at point C', to thereby form line O-C'. Then, a circle R is drawn that joins points A', B', and C'. In the illustrated method, the center of circle R can be found by first drawing a line connecting points C' and A' to form line C'-A', and drawing another line from the mid point of line C'-A', perpendicularly to line C'-A', until it reaches line O-A'. This process may be repeated for a suitable number of times, for example twenty times to generate twenty circles R that are radially evenly spaced from each other, to define ten openings 64 for ten radial waveguides, respectively.

Figure 4B:
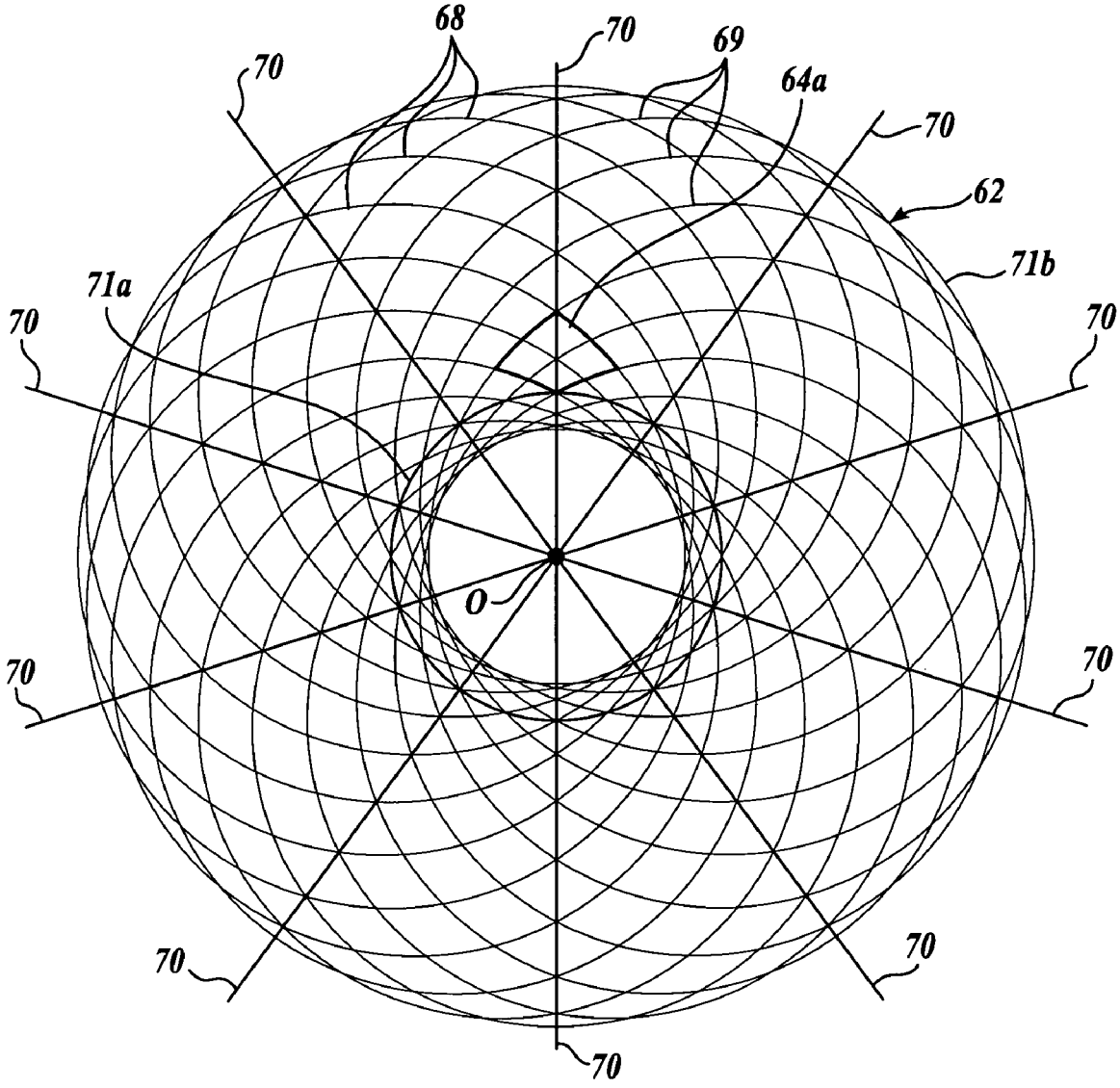

Referring to FIG. 4B, based on the twenty circles R drawn according to the process of FIG. 4A on the surface of the initial horn section 62 defined by the inner edge 71*a* and the outer edge 71*b*, twenty intersecting arcs 68 curving to the left are found at even spacing and twenty intersecting curves 69 curving to the right are found also at even spacing. Then, a first diamond shape 64*a* is found, as shown, which contacts (or touches) the inner edge 71*a*. Specifically, since at least ten openings should be defined in the illustrated embodiment to each provide an exit for one of the ten waveguides defined through the acoustic transformer 34, the initial horn section 62 is equiangularly divided into ten sections by ten lines 70, which each radially extends from the center (O) of the initial horn section 62. The first diamond shape 64*a* can be found on each of these ten lines 70.

Figure 4C:
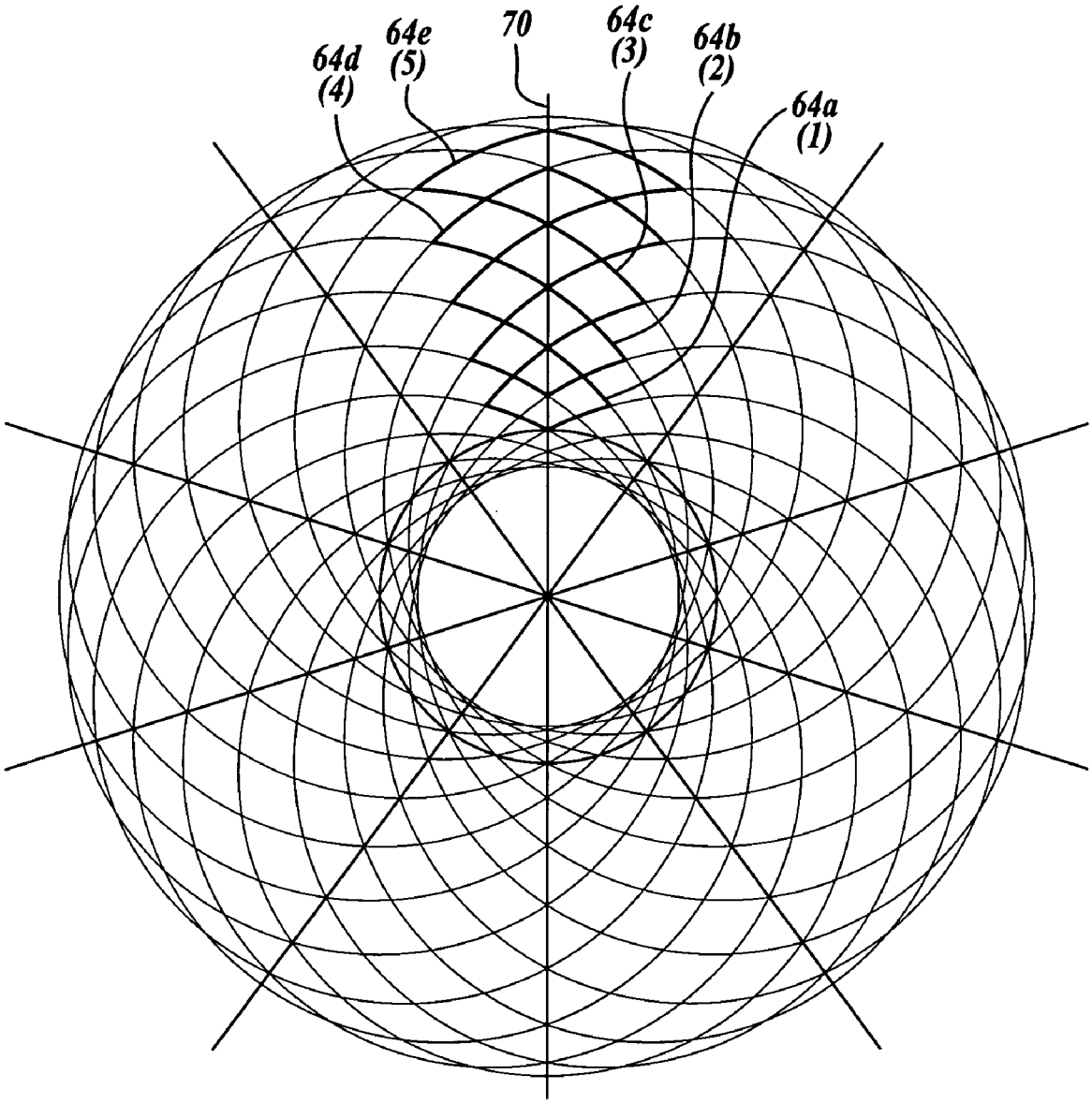

Referring to FIG. 4C, on each of the ten lines 70, four other adjacent diamond shapes 64*b*-64*e* are also found. Thus, on each of the ten lines 70, five diamond shapes 64*a*-64*e* can be found. Further, as illustrated, the five diamond shapes 64*a*-64*e* are associated with numbers "1," "2," "3," "4," and "5," respectively. As each line 70 corresponds to a waveguide defined through the acoustic transformer 34, on each line 70, one or more diamond shapes can be chosen to define an opening (or openings) to serve as an exit for the waveguide.

Figure 4D:
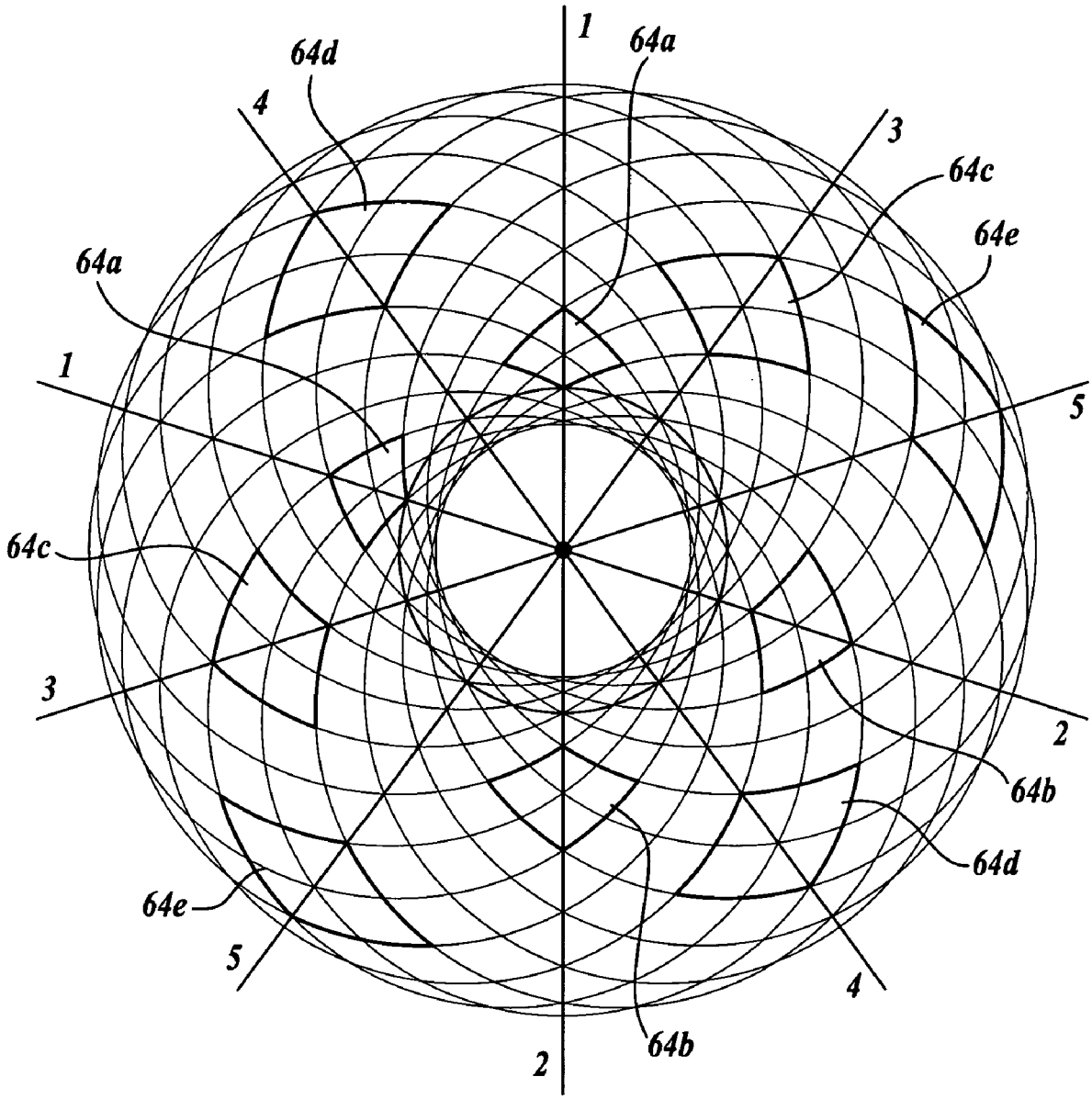

FIG. 4D illustrates one example of defining openings 64 to serve as exits for the waveguides through the acoustic transformer 34, in which one diamond shape is selected per each line 70 to define an opening 64. In this example, each of the five diamond shapes 64*a*-64*e* is used twice (i.e., along two lines 70), and the diamond shapes 64*a*-64*e* associated with numbers "1"-"5" are arranged so that there is no less than a numerical difference of "2" between two adjacent diamond shapes. These arrangements are made to maintain sufficiently large portions of solid surfaces (sidewalls) for the initial horn section 62, while randomizing open surfaces for the MF acoustic signals. The locations of the openings 64 are also randomized for the HF acoustic signals to avoid any large nulls at any particular frequency/wavelength. The inventors of the present application have found that, in various exemplary embodiments of the present invention, the ratio between the total area of openings and the total area of solid surfaces (i.e., the total area of the initial horn section 62 minus the total area of openings) is preferably about 15-30% (open) and 85-70% (solid), and further preferably 20% (open) and 80% (solid), in order for the initial horn section 62 to transmit sufficient MF energy through its sidewall while at the same time functioning as a waveguide for the HF energy. It should be understood, however, that ratios other than those described herein may be used depending on each application, as long as the openings 64 of the initial horn section 62 allow sufficient MF energy to pass through while substantially blocking HF energy.

It should be understood that in some applications the openings 64 may be covered with some material (different from the material used to form the initial horn section 62), which still allows sufficient MF energy to pass through while substantially blocking HF energy.

Figure 4E:
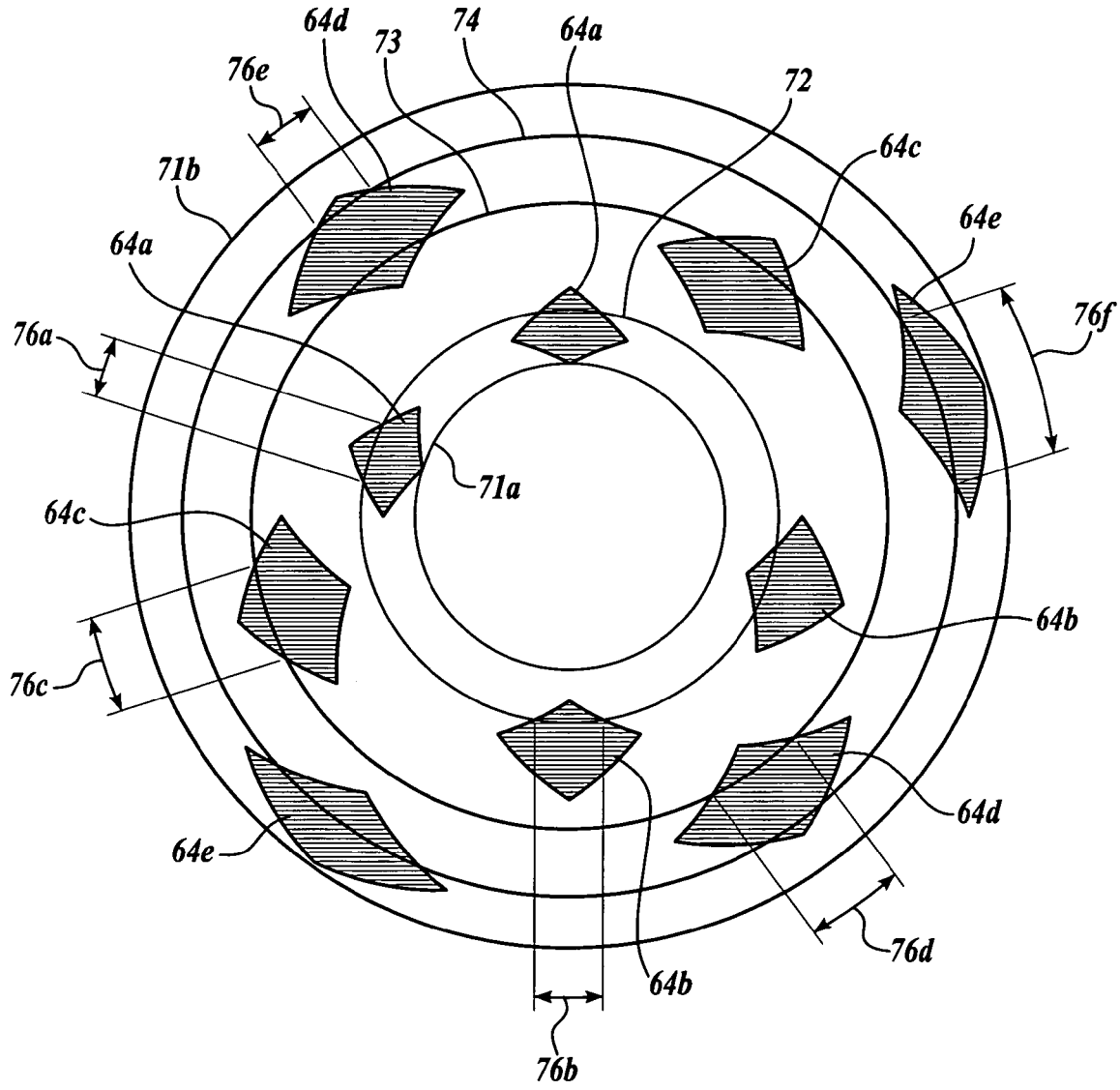
Figure 4F:
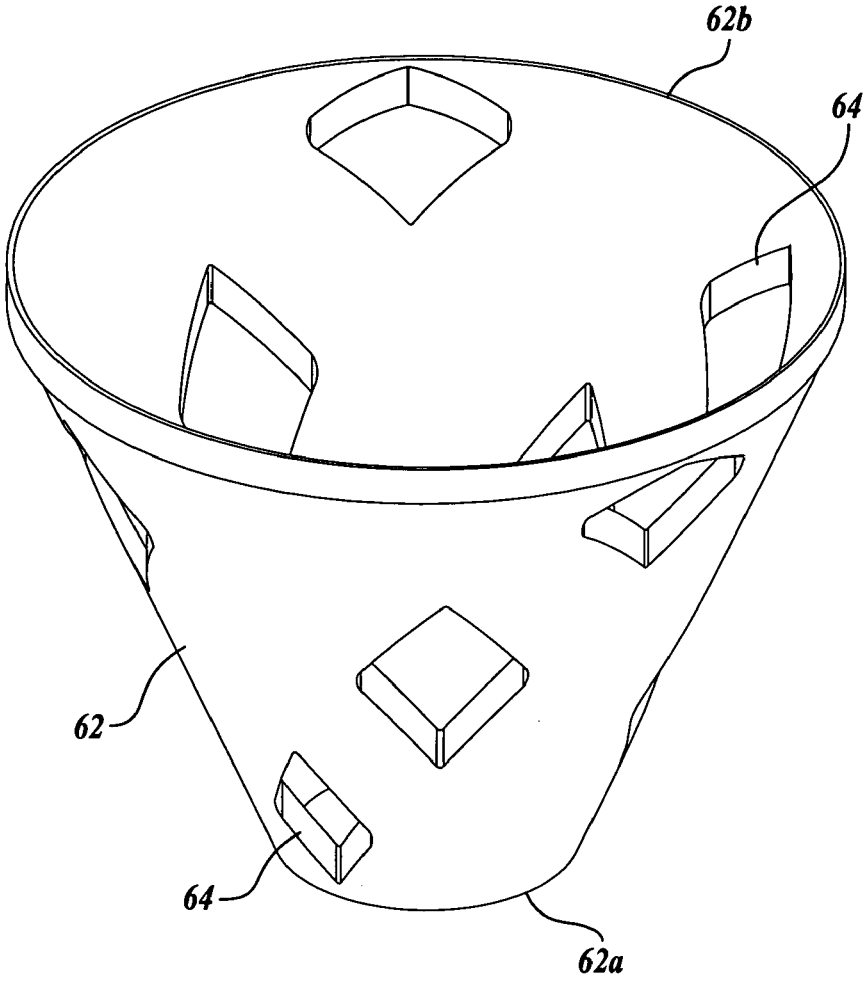

FIG. 4E shows the opening pattern resulting from the method described above in reference to FIGS. 4A-4D, and FIG. 4F shows the initial horn section 62 including the defined openings 64. To illustrate exemplary locations and dimensions of the openings 64, three circles 72, 73, and 74 are defined on the surface of the initial horn section 62, having diameters of 2.552", 3,733", and 4.556", for example. These circles 72, 73, and 74 are also defined to jointly illustrate advancing acoustic signal paths, crossing circles 72, 73, and 74 in this order through the generally conical volume 66. The first circle 72 extends through two first diamond shapes 64*a* and two second diamond shapes 64*b*. The arc length 76*a* and the arc length 76*b* along which the first and second diamond shapes 64*a* and 64*b* open up (or cut) the first circle 72 may be 0.415" and 0.386", respectively, for example. The second circle 73 extends through two third diamond shapes 64*c* and two fourth diamond shapes 64*d*, and the arc length 76*c* and the arc length 76*d* along which the third and fourth diamond shapes 64*c* and 64*d* open up the second circle 73 may be 0.822" and 0.351", respectively, for example. Lastly, the third circle 74 extends through two fourth diamond shapes 64*d* and two fifth diamond shapes 64*e*. The arc length 76*e* and the arc length 76*f* along which the fourth and fifth diamond shapes 64*d* and 64*e* open up the third circle 74 may be 0.424" and 1.007", respectively, for example. In the illustrated example, the opening ratio along the first, second, and third circles 72, 73, and 74 can be calculated as follows:

| | |
|---|---|
| 1st circle (72): | Diameter = 2.552, Circumference = 8.017 |
| | Total "open" arc length = (0.386 × 2) + (0.415 × 2) = 1.602 |
| | Opening ratio = 1.602/8.017 = 20% |
| 2nd circle (73): | Diameter = 3.733, Circumference = 11.728 |
| | Total "open" arc length = (0.351 × 2) + (0.822 × 2) = 2.346 |
| | Opening ratio = 2.346/11.728 = 20% |
| 3rd circle (74): | Diameter = 4.556, Circumference = 14.313 |
| | Total "open" arc length = (0.424 × 2) + (1.007 × 2) = 2.862 |
| | Opening ratio = 2.862/14.313 = 20% |

Thus, the illustrated example of the initial horn section 62 or, more specifically, any path length along the sidewall of the initial horn section 62, generally satisfies the 20%-80% ratio between the total area of openings and the total area of solid surfaces.

Figure 4G:
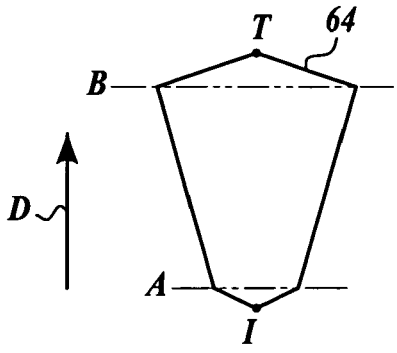

While the above-described embodiment uses generally diamond-shaped openings 64, the shapes of openings are not so limited. In various exemplary embodiments of the present invention, the shape of an opening is defined by linear edges. Openings defined with linear edges may be advantageous in that they tend to interfere less with HF energy transmitted through the initial horn section 62, as compared with curved edges. Specifically, if the openings 64 are defined with linear edges, any HF wavefront passing by such openings would "see" constant gradient(s) of increasing (or decreasing) openness provided by the linear edges, to thereby experience less interference or, more precisely, consistent interference. For example, FIG. 4G illustrates a sample shape of an opening 64 defined by linear edges. This shape is defined by two angled lines that are diverging from an initial point I toward line "A," further diverging from line "A" toward line "B" at a smaller diverging angle, and finally converging onto a terminal point T, along the direction of travel "D" of the HF wavefront. The shape is defined to generally provide an increasingly larger open area to compensate for the ever-increasing cross section of the initial horn section 62. In this case, the HF wavefront D traveling through the initial horn section 62 sees a constant gradient of increasing openness from the initial point I toward line "A," another constant gradient of increasing openness from line "A" toward line "B," and a constant gradient of decreasing openness from line "B" toward the terminal point T. On the other hand, the openings 64 defined with curved edges (e.g., circle or oval openings) do not have a constant gradient that an HF wavefront could see and, consequently, the curved edges may interfere with transmission of HF energy past the curved openings. For example, any circle or a combination of circles provides a shape in which the gradient is constantly changing, often abruptly. The changing gradient may lead to more interference, or more precisely, inconsistent interference, affecting different frequencies (corresponding to different locations along the surface of the initial horn section 62) differently. That is, at some frequencies, the surface of the initial horn section 62 will appear more opaque than at other frequencies. Accordingly, in general, an opening may preferably consist of an initial "point" (openness=0), which then expands (and shrinks) linearly along the direction of travel of the HF wavefront. Two angled lines diverging from the initial point, which then converge onto a terminal point, achieve this requirement, and shapes such as those shown in FIG. 4G, a diamond, square, etc., provide such two angled lines.

In various exemplary embodiments of the present invention, each of the openings 64 defined through the initial horn section 62 may be associated with a fin 67, best shown in FIGS. 2A and 3B, to further block or minimize passing of HF energy through the openings 64. Specifically, one of the functions of the openings 64 is to prevent HF energy passing through the conical volume 66 of the initial horn section 62 from entering any of the plurality of waveguides defined through the acoustic transformer 34. Any HF energy that may enter the plurality of waveguides through the openings 64 may reflect off of the inner surfaces of the phase plug body 44 and/or the surfaces of the peaks 56 of the peak/valley member 46 and be re-transmitted later in time through the openings 64 back into the conical volume 66, causing a temporally non-coherent acoustic signal. Therefore, the fins 67 may be provided behind each of the openings 64 so as to minimize the distance that an HF signal could travel into the corresponding waveguide before being reflected back (by the fin 67) into the conical volume 66. The inclusion of the fins 67, in addition to the configuration and arrangement of the openings 64 to maintain minimal and constant (yet randomized) open area, will minimize passing of the HF energy through the openings 64. This in turn facilitates the function of the initial horn section 62 as a waveguide for the HF energy. In various exemplary embodiments of the present invention, these fins 67 are oriented generally in parallel with the advancing direction of MF energy, while being generally perpendicular to the advancing direction of any HF energy escaping from the conical volume 66.

According to the present invention, a coaxial mid-frequency and high-frequency loudspeaker is provided, including a novel configuration of an acoustic transformer that provides for (1) constant expansion of a waveguide for acoustic signals, and (2) temporal coherence of acoustic signals. Such acoustic transformer in turn permits the use of the loudspeaker with a variety of horns. Specifically, since the acoustic transformer ensures constant expansion of a waveguide for acoustic signals leading to the throat 36*e* of the horn 36 and also temporal coherence of acoustic signals at the throat 36*e* of the horn 36, horns of various horizontal/vertical angles, shapes, etc., may be coupled to the acoustic transformer 34 as long as the selected horn satisfies the constant expansion rule for the acoustic signal waveguide. For example, horns having horizontal and vertical angles of 45°×45°, 60°×45°, 60°×60°, and 90°×60° may be interchangeably coupled to the acoustic transformer 34 of the loudspeaker constructed in accordance with the present invention, depending on each application. Further, any horn coupled to the acoustic transformer 34 may thereafter be adjustably rotated depending on each application.

It should be apparent to one skilled in the art that a coaxial mid-frequency and high-frequency loudspeaker of the present invention may include two or more sets of the coaxial transducer 32 and the acoustic transformer 34 that are configured according to the description above. In the present description, a combination of a coaxial transducer and an acoustic transformer is referred to as a "coaxial assembly." According to various exemplary embodiments of the present invention, a coaxial mid-frequency and high-frequency loudspeaker includes one or more coaxial assemblies.

Figure 5A:
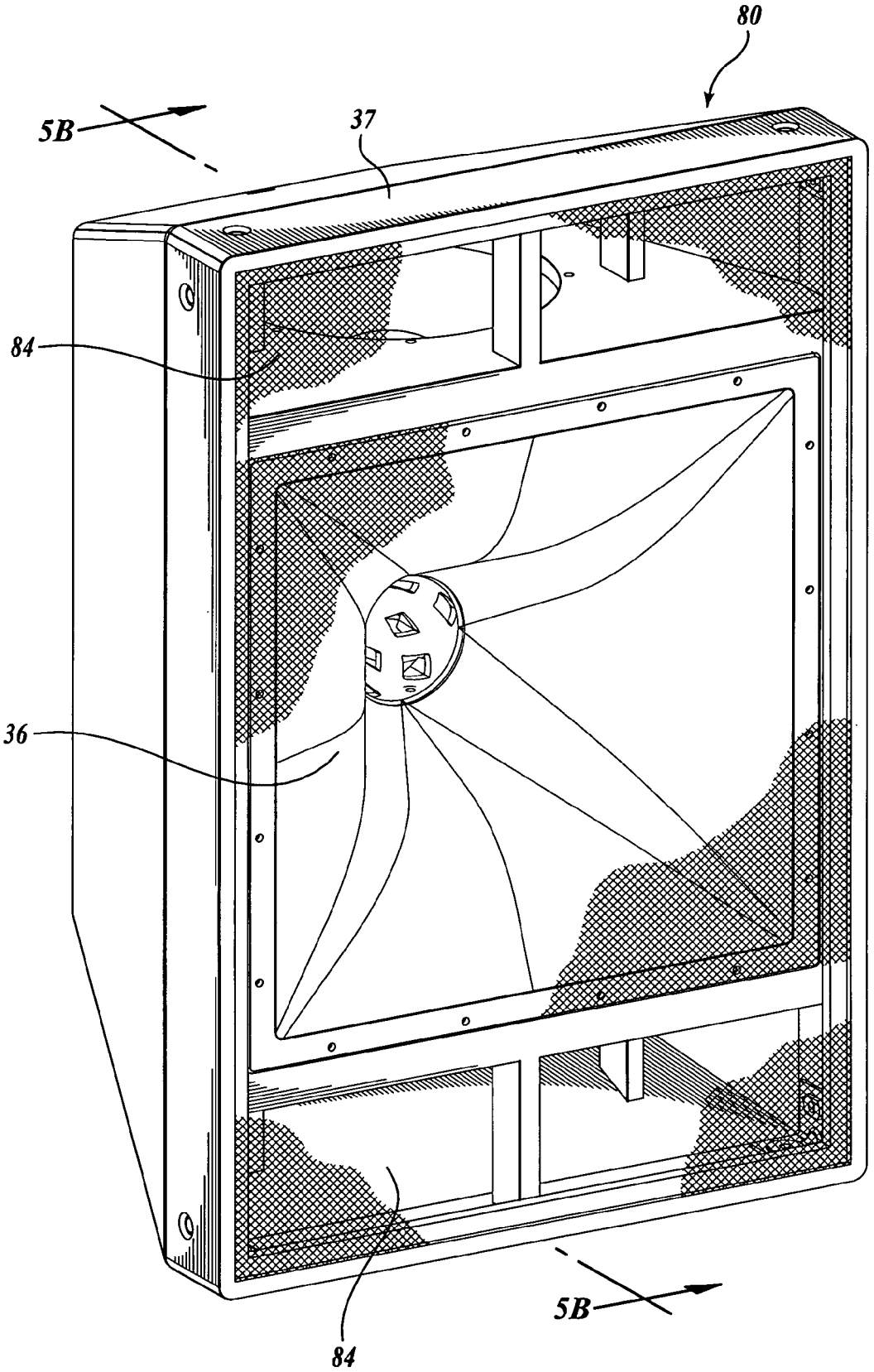
FIG. 5A is a perspective view of a coaxial mid-frequency and high-frequency loudspeaker in an enclosure, further including a pair of low-frequency drivers, formed in accordance with one embodiment of the present invention.
Figure 5B:
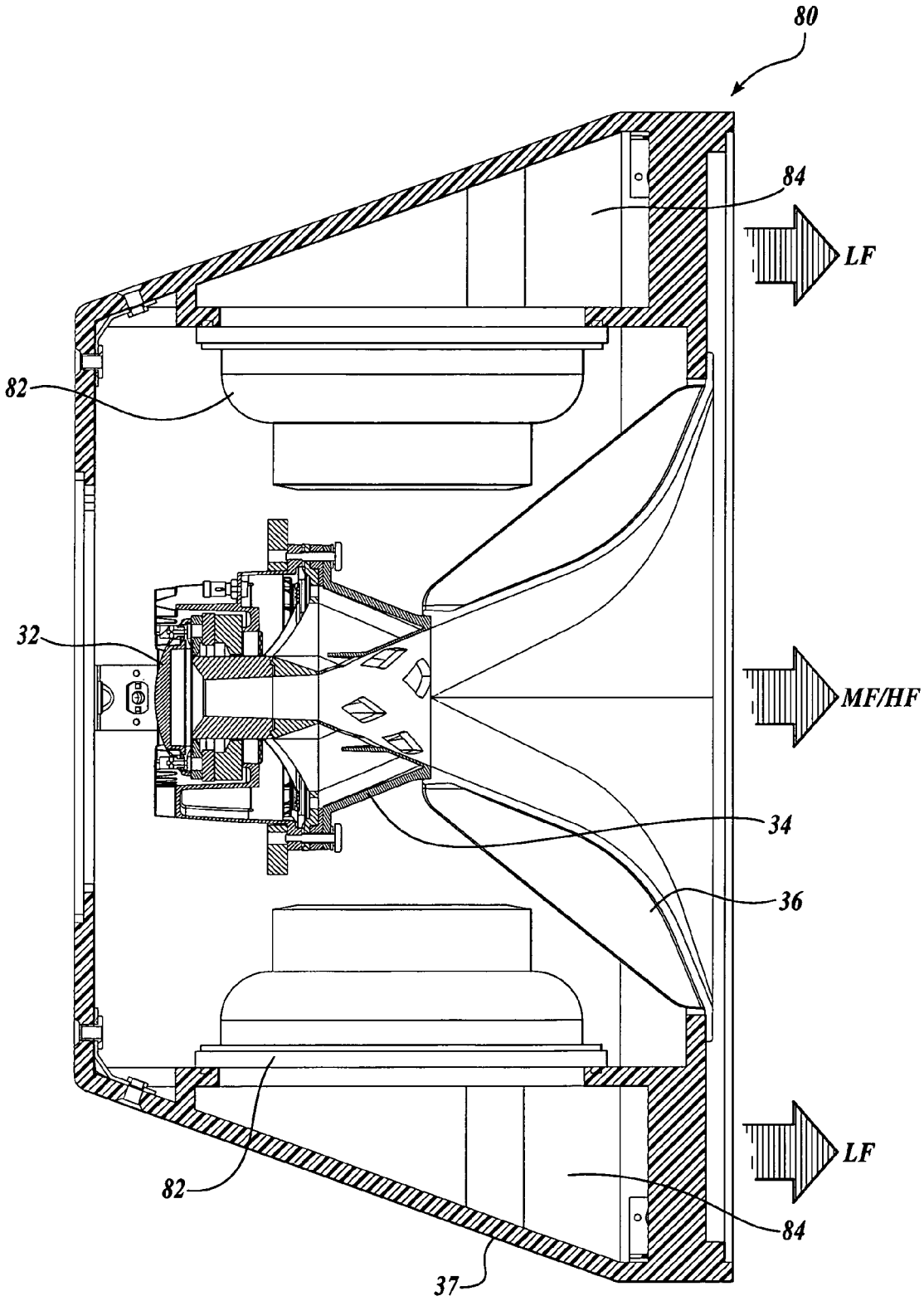
FIG. 5B is a cut-away view of the loudspeaker of FIG. 5A.

A coaxial mid-frequency and high-frequency loudspeaker of the present invention may additionally include one or more drivers (or transducers). For example, a coaxial mid-frequency and high-frequency loudspeaker may include one or more low-frequency drivers, to achieve a full-range loudspeaker. As used herein, low frequency (LF) refers to a frequency range of below about 200 Hz. FIGS. 5A and 5B illustrate one example of a full-range loudspeaker 80, including the coaxial transducer 32, the acoustic transformer 34, and the horn 36, all contained within an enclosure 37, as described above. The loudspeaker 80 also includes two low-frequency drivers (woofers) 82 symmetrically provided on both sides of the coaxial assembly (including the coaxial transducer 32 and the acoustic transformer 34), which produce low-frequency acoustic signals through separate side horns 84 arranged on both sides of the horn 36. The arrangement as shown in FIGS. 5A and 5B results in a loudspeaker that has a symmetric acoustic pattern along the full range of frequencies both horizontally and vertically. Further, to maintain coverage symmetry and consistency over the widest possible operating band, a plurality of loudspeakers 80 can be arrayed horizontally or vertically, as will be apparent to one skilled in the art.

While the preferred embodiments of the invention have been illustrated and described, it will be appreciated that various changes can be made therein without departing from the spirit and scope of the invention.

The embodiments of the invention in which an exclusive property of privilege is claimed are defined as follows:

1. A loudspeaker for receiving an electrical signal and transmitting an acoustic signal through a transmission medium, comprising:

(a) a coaxial transducer for receiving the electrical signal and producing the acoustic signal representative of the electrical signal, the coaxial transducer comprising:

(i) a high-frequency driver arranged to transmit high-frequency acoustic signals generally along a central axis of the coaxial transducer; and (ii) a mid-frequency driver that is coaxially arranged relative to the high-frequency driver, the mid-frequency driver including a diaphragm about the central axis of the coaxial transducer through which mid-frequency acoustic signals are transmitted; and (b) an acoustic transformer having a first end positioned adjacent to the coaxial transducer and a second end opposite therefrom, the acoustic transformer comprising:

(i) a plurality of waveguides to transmit the mid-frequency acoustic signals from the diaphragm to the second end of the acoustic transformer; and (ii) an initial horn section comprising a sidewall that expands in a direction from the first end to the second end of the acoustic transformer, the sidewall being acoustically substantially opaque to the high-frequency acoustic signals to thereby function as a waveguide for the high-frequency acoustic signals, and the sidewall being acoustically substantially transparent to the mid-frequency acoustic signals to thereby transmit, via its surface, the mid-frequency acoustic signals exiting from the waveguides to the second end of the acoustic transformer.

2. The loudspeaker of claim 1, further comprising a horn disposed adjacent to the second end of the acoustic transformer.

3. The loudspeaker of claim 1, wherein the initial horn section includes a plurality of openings provided through the sidewall.

4. The loudspeaker of claim 3, wherein the openings through the initial horn section are defined based on intersecting arcs.

5. The loudspeaker of claim 3, wherein a ratio between a total area of the openings through the initial horn section and a total area of the initial horn section ranges from about 15% to 30%.

6. The loudspeaker of claim 5, wherein the ratio is about 20%.

7. The loudspeaker of claim 3, wherein a shape of each of the openings is defined by linear edges.

8. The loudspeaker of claim 3, wherein the initial horn section further comprises a plurality of fins provided adjacent to the plurality of openings, respectively.

9. The loudspeaker of claim 1, wherein the acoustic transformer is configured to equalize acoustic path lengths for the mid-frequency signals from the diaphragm to the second end of the acoustic transformer.

10. The loudspeaker of claim 1, wherein the acoustic transformer comprises:

(a) a phase plug core; and (b) a phase plug body that generally encloses the phase plug core, to together define the plurality of waveguides, the phase plug body including the initial horn section.

11. The loudspeaker of claim 10, wherein the phase plug core further comprises:

(i) a radially slotted disk defining a plurality of radially extending slots; and (ii) a radial peak/valley member defining a plurality of valleys between a plurality of peaks, wherein the plurality of radially extending slots and the plurality of valleys are aligned so as to together form the plurality of waveguides that are radially arranged and are extending through the acoustic transformer substantially in parallel to the central axis of the coaxial transducer.

12. The loudspeaker of claim 1, wherein the high-frequency driver and the mid-frequency driver in the coaxial transducer share a single magnet.

13. The loudspeaker of claim 1, further comprising one or more low-frequency drivers that are arranged adjacent to the coaxial transducer.

14. The loudspeaker of claim 13, wherein two low-frequency drivers are provided on both sides of the coaxial transducer about the central axis of the coaxial transducer.

15. A loudspeaker for receiving an electrical signal and transmitting an acoustic signal through a transmission medium, comprising:

(a) a coaxial transducer for receiving the electrical signal and producing the acoustic signal representative of the electrical signal, the coaxial transducer including a high-frequency driver and a mid-frequency driver that are coaxially arranged; and (b) an acoustic transformer coupled to the coaxial transducer, the acoustic transformer comprising an initial horn section comprising a sidewall that expands from a first end to a second end in a direction away from the coaxial transducer, the sidewall defining a plurality of openings therethrough, wherein the sidewall is acoustically opaque to high-frequency acoustic signals to thereby function as a waveguide for the high-frequency acoustic signals while the sidewall including the openings is acoustically transparent to mid-frequency acoustic signals.

16. The loudspeaker of claim 15, wherein the openings through the sidewall are defined based on intersecting arcs.

17. The loudspeaker of claim 15, wherein a ratio between a total area of the openings through the initial horn section and a total area of the initial horn section ranges from about 15% to 30%.

18. The loudspeaker of claim 17, wherein the ratio is about 20%.

19. The loudspeaker of claim 15, wherein a shape of each of the openings is defined by linear edges.

20. A method for delivering both high-frequency and mid-frequency acoustic energy through a loudspeaker including a horn to a transmission medium, the method comprising the steps of:

(a) arranging a high-frequency driver configured to produce high-frequency acoustic energy;

(b) arranging a mid-frequency driver configured to produce mid-frequency acoustic energy in a manner coaxial to the high-frequency driver; and (c) arranging an acoustic transformer including an initial horn section comprising a sidewall, wherein the sidewall is acoustically substantially opaque to the high-frequency acoustic energy and is acoustically substantially transparent to the mid-frequency acoustic energy, the initial horn section expands from a first end to a second end in a direction away from the high-frequency driver to thereby function as a waveguide for the high-frequency acoustic energy leading to the horn of the loudspeaker, and the acoustic transformer functions to deliver the mid-frequency acoustic energy in a temporally coherent manner from the mid-frequency driver to the horn of the loudspeaker.

21. The loudspeaker of claim 1, wherein the initial horn section comprising the sidewall that expands in a direction from the first end to the second end defines an internal volume through which both the high-frequency acoustic signals and the mid-frequency acoustic signals travel.

22. The loudspeaker of claim 15, wherein the initial horn section comprising the sidewall that expands in a direction from the first end to the second end defines an internal volume through which both the high-frequency acoustic signals and the mid-frequency acoustic signals travel.

* * * * *